US006601977B2

(12) United States Patent
Gesue

(10) Patent No.: US 6,601,977 B2
(45) Date of Patent: Aug. 5, 2003

(54) DIRECT PLUG ELECTRIC CANDLE LIGHTING SYSTEM

(76) Inventor: Rick Gesue, 3213 Vance Rd., Monkton, MD (US) 21111

( * ) Notice: Subject to any disclaimer, the term of this patent is extended or adjusted under 35 U.S.C. 154(b) by 0 days.

(21) Appl. No.: 10/076,917

(22) Filed: Feb. 13, 2002

(65) Prior Publication Data

US 2003/0026087 A1 Feb. 6, 2003

Related U.S. Application Data

(60) Provisional application No. 60/309,217, filed on Aug. 1, 2001.

(51) Int. Cl.[7] ..... F21P 1/02

(52) U.S. Cl. ..... 362/392; 362/95; 362/391; 362/393; 362/414; 362/810

(58) Field of Search ..... 362/95, 392, 810, 362/226, 227, 234, 249, 250, 393, 806, 808, 431, 414; 439/106, 100

(56) References Cited

U.S. PATENT DOCUMENTS 5,601,360 A * 2/1997 Paquette ..... 362/226
5,829,869 A * 11/1998 Clegg et al. ..... 362/392
6,390,647 B1 * 5/2002 Shaefer ..... 362/276

* cited by examiner

*Primary Examiner*—Sandra O'Shea
*Assistant Examiner*—John Anthony Ward
(74) *Attorney, Agent, or Firm*—Law Offices of Royal W. Craig

(57) ABSTRACT

A direct plug electric candle lighting system is herein disclosed. The system comprises an electric single outlet/receptacle mounted in a window sill and an electric candle assembly designed to plug directly into the single outlet/receptacle. The window sill-mounted single outlet/receptacle includes a three-wire, grounded single outlet/receptacle rated for a maximum current of 15 amps and a maximum voltage of 125 volts and a decorative metallic cover plate. The electric candle assembly may include a grounded plug rated for a maximum current of 15 amps and a maximum voltage of 125 volts, a decorative metallic base, a plastic candle body, and a low wattage, flame-shaped light bulb.

9 Claims, 7 Drawing Sheets

DIRECT PLUG ELECTRIC CANDLE LIGHTING SYSTEM

CROSS-REFERENCE TO RELATED APPLICATIONS

The present application derives priority from U.S. Provisional Patent Application No. 60/309,217 for "DIRECT PLUG ELECTRIC CANDLE LIGHTING SYSTEM; Filed: Aug. 1, 2001; Inventor: Gesue, Rick.

BACKGROUND OF THE INVENTION

1. Field of the Invention

The present invention relates to decorative electric candle lighting systems and, more particularly, to a lighting system in which modular 120 V.A.C. electric candles can be inserted directly into grounded, code-certified receptacles directly in a window sill.

2. Description of the Background

It is a longstanding tradition to place candles in the windows of a home during the holiday season. However, due to the danger associated with an open flame in proximity to flammable materials such as curtains/draperies, electric candle systems have evolved to take the place of traditional candles. Given their ease of use, colonial "look", and comparative safety of operation (with open flame) many people leave the electric candles up year round.

However, even electric candle assemblies have certain drawbacks. Generally, they must be taped or otherwise held down to prevent their falling over, and their electric cords must be connected to 120 VAC outlets/receptacles. In homes with a limited number of outlets/ receptacles one or more extension cords are usually required. If the intent is to place electric candles in more than one window, then the electric cords typically spoil the decorative effect from the inside. Moreover, the multiple cords create potentially unsafe situations and cause many house fires. While new home construction often includes the installation of a sufficient number of electric outlets/receptacles (with many located directly below a window) to alleviate the aforementioned situation, a cord of some length is still required to provide electricity to the candle.

Electric candle systems have evolved to address the tendency to fall over and the need for electric cords. For example, one electric candle system designed for installation in the window sills of a house is described in U.S. Pat. No. 5,601,360 to Paquette. The patent discloses the combination of a low-voltage (12 VDC) socket installed in a window sill and an electric candle with a low-voltage bulb at the top and a pair of prongs at the bottom. The prongs engage the contacts provided in the socket when the candle is slipped therein.

However, the Paquette '360 invention leaves room for improvement in several respects. Specifically, low voltage systems use custom components that are less readily available than those used in a comparable 120 VAC system. Unlike the 120 VAC electrical service provided by public utilities for general consumption, 12 V.DC. power must be generated on-site by one or more step-down transformers. Due to the relatively rapid degradation of 12 V.DC. power, as compared with that of 120 VAC service, more than one transformer may be required depending on the linear distance that must be traveled to reach the last electric candle in the system.

In addition to the foregoing, proper safety considerations must be taken in areas used by children, and these may include design considerations which prevent access to exposed wiring or electrical outlets.

It would be of great advantage to provide an electric candle lighting system that retains certain beneficial and safety features (e.g. candles that do not fall over, no visible/ external cords) of the prior art, plus adds the ease of use/installation and economies provided by line voltage systems utilizing 120 VAC electric service.

SUMMARY OF THE INVENTION

It is, therefore, the primary object of the present invention to provide a direct plug electric candle lighting system that includes one or more window sill-mounted outlets/ receptacles and that operates on standard 120 VAC electric service, all of which may be controlled by a standard wall switch.

It is another object to provide a direct plug electric candle lighting system that utilizes cost effective, readily available electric components meeting all applicable codes/ regulations, which can be installed by electricians using standard residential wiring practices, and which is fully grounded for complete safety.

Specifically, it is an object to provide a means to prevent inadvertent/unintentional removal of the candles from window sill-mounted outlet/receptacle to avoid shock hazard.

It is a further object to provide a direct plug electric candle lighting system wherein the color of candle's light can be changed, or the candle's height, or the exterior color or finish of the candle, to reflect a change in the season/holiday or to match a change in the decor surrounding the window.

It is still another object to provide a direct plug electric candle lighting system wherein multiple candle units can be used to replace a single candle to reflect a change in the season/holiday, or to match a change in the decor surrounding the window.

It is another object to provide a direct plug electric candle lighting system wherein the window sill-mounted outlet/ receptacle can be utilized as an ordinary 120 VAC outlet when the direct plug candle is not in use.

According to the present invention, the above-described and other objects are accomplished by a lighting system comprising an electric outlet/receptacle mounted in a window sill and an electric candle assembly designed to plug directly into the outlet/receptacle. The window sill-mounted outlet/receptacle includes a three-wire, grounded outlet/ receptacle rated for a maximum current of 15 amps and a maximum voltage of 125 volts and a decorative cover plate. The electric candle assembly is a fully grounded system including a grounded plug rated for a maximum current of 15 amps and a maximum voltage of 125 volts, a decorative, metallic base, a plastic candle body, and a low wattage, flame-shaped light bulb.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
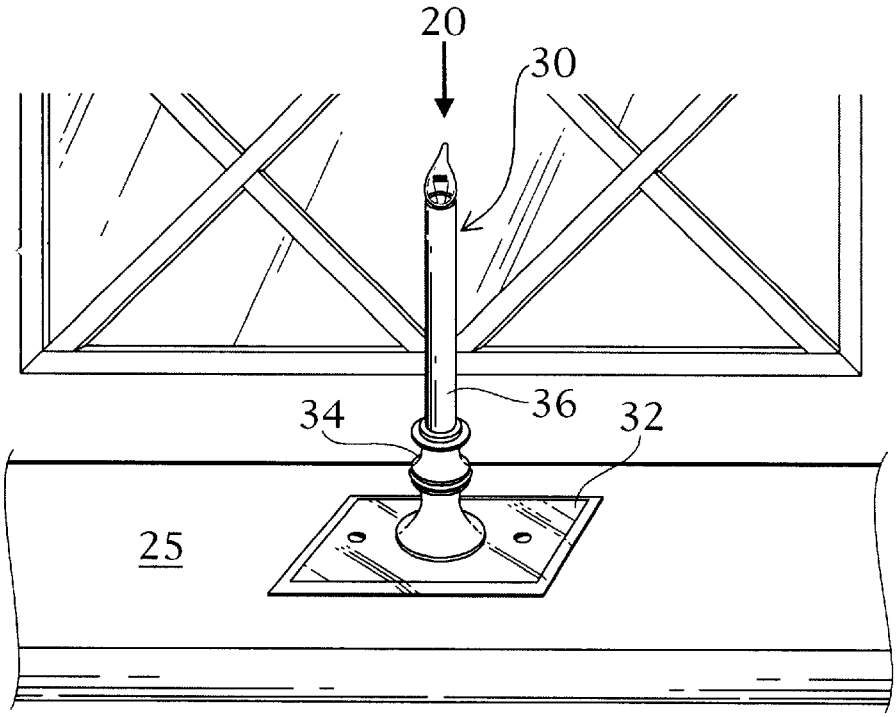
FIG. 1 is a perspective view of the direct plug electric candle lighting system 20 according to a first "plate under" embodiment of the present invention as mounted on an exemplary window sill 25.

FIG. 1 is a perspective view of the direct plug electric candle lighting system 20 according to a first embodiment of the present invention as mounted on an exemplary window sill 25. The electric candle lighting system 20 generally includes a standing candle assembly 30 secured in an outlet/receptacle assembly (obscured beneath a cover plate 32) which is mounted in a hollow framed window sill 25. The candle assembly 30 typically includes an external base 34 and a candle body 36.

Figure 2:
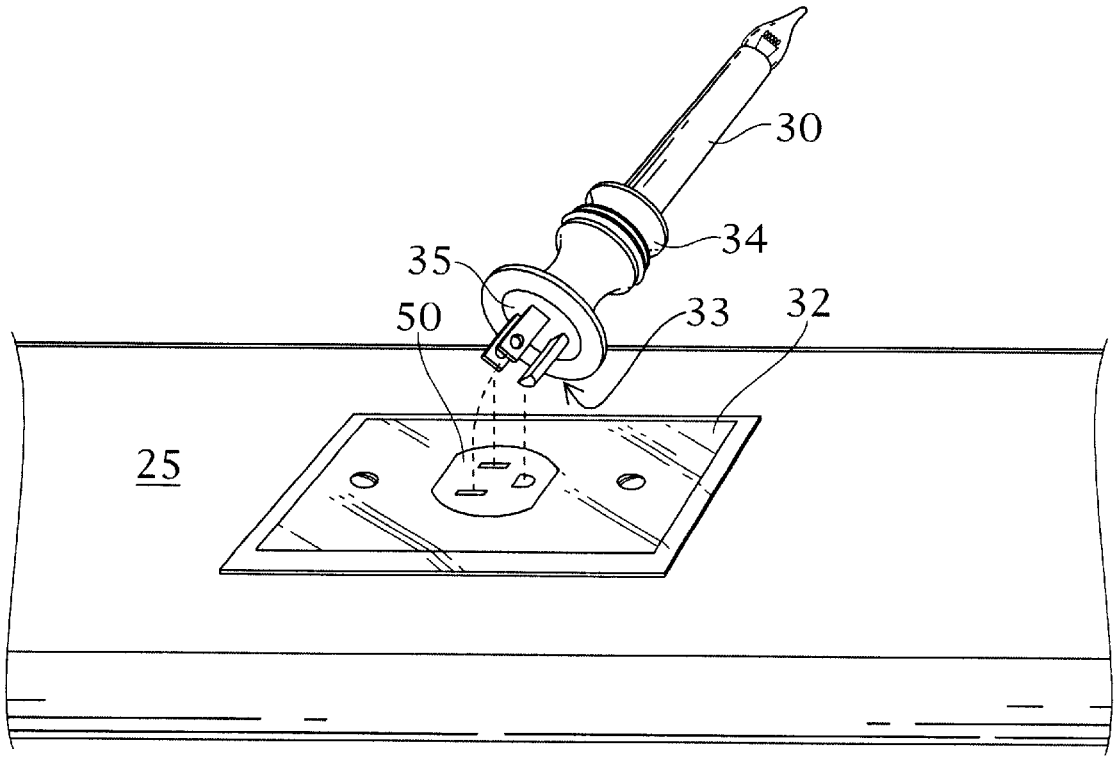
FIG. 2 is a close-up view of the exemplary window sill 25, cover plate 32, and external base 34 of the direct plug electric candle lighting system 20 as in FIG. 1 with candle assembly 30 removed (to the side).

FIG. 2 is a close-up view of the exemplary window sill 25 and cover plate 32 of the direct plug electric candle lighting system 20 as in FIG. 1 with candle assembly 30 removed from the single outlet/receptacle assembly 50.

The cover plate 32 is a conventional receptacle cover preferably finished consistent with the other components of the system (brass, pewter, burnished bronze, etc.).

Window sill 25 is formed as a hollow framed assembly for housing one or more conventional UL-approved 120 VAC single-outlet receptacles. Each outlet/receptacle assembly 50 housed therein is preferably a commercially available, three-wire, grounded single outlet/receptacle rated for a maximum current of 15 amps and a maximum voltage of 125 volts.

There may be any number of single outlet/receptacle assemblies 50 spaced lengthwise along a single window sill 25. For each one, the top surface of the window sill 25 is formed with aperture(s) for mounting the receptacle(s) 50 lengthwise, each in a switch box (as will be described), and cover plate 32 covers the receptacles in the switch boxes. In addition, several window sills 25 may be physically and/or electrically joined in a single direct plug electric candle lighting system 20, whereby power to all of the outlets/receptacles 50 is conveniently controlled by a single wall switch.

The candle assemblies 30 each include a conventional three-prong plug 33 which may be inserted directly into the receptacles 50 (through cover plate 32). An external base 34 is fitted over the three-prong plug 33 to provide both safety and aesthetic benefits. Three-prong receptacles 50 and three-prong plugs 33 are important features of the present invention because they provide a proper ground circuit for the system 20 as will be described, and at the same time they provide sturdy three-point support for the standing candle assembly 30.

Figure 3:
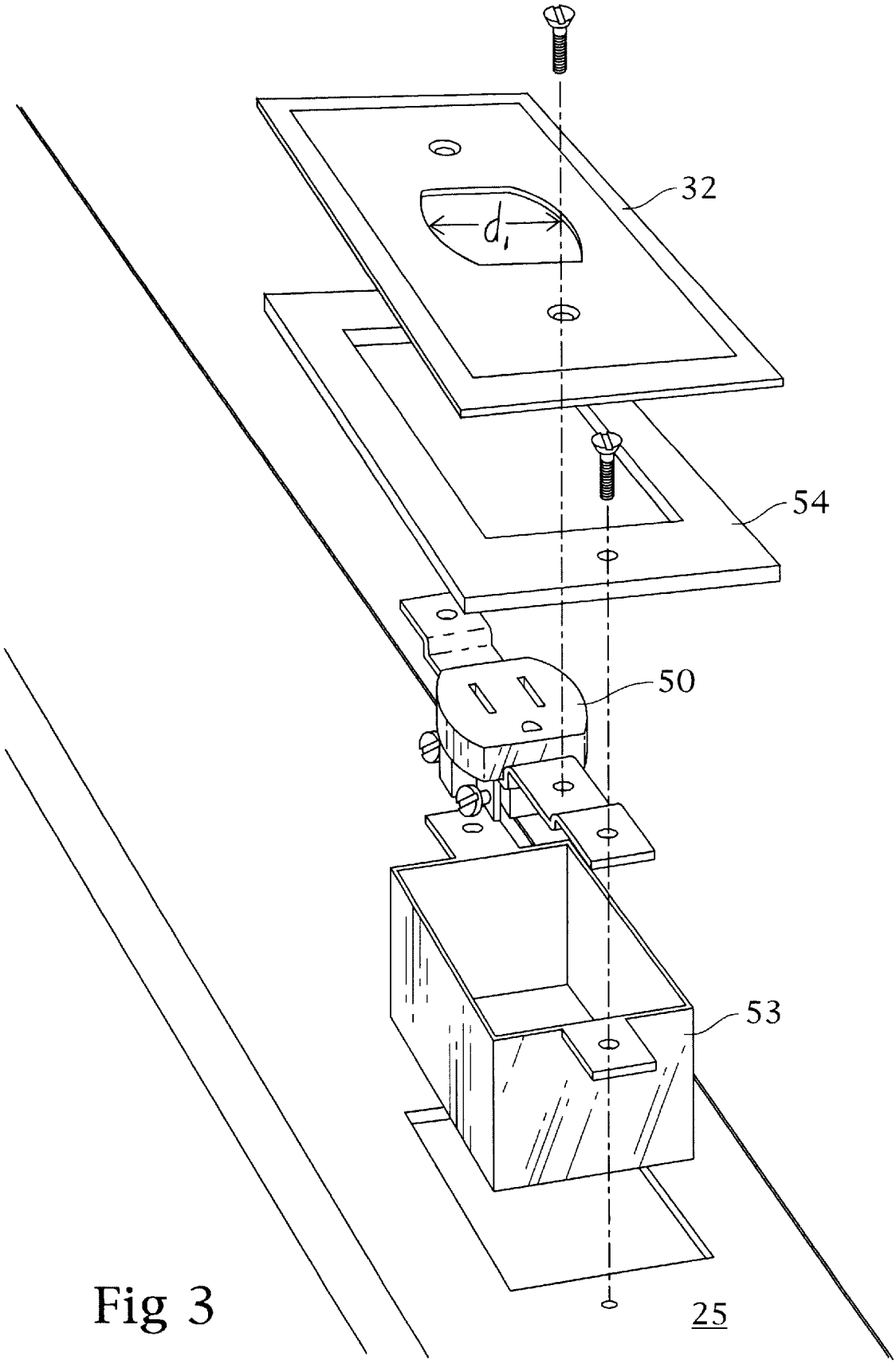
FIG. 3 is an exploded perspective view of the exemplary window sill 25, cover plate 32, and external base 34 of the direct plug electric candle lighting system 20 adapted for a "plate over" mounting configuration according to a second embodiment of the present invention.

FIG. 3 is a close-up exploded view of window sill 25 with electric candle assembly 30 and cover plate 32 removed, illustrating an exemplary mounting configuration for the single outlet/receptacle 50. The mounting configuration of FIG. 3 is known as the "plate over" configuration. Here, the switch box 53 is mounted approximately ¼" below the surface of the window sill 25. The single outlet/receptacle 50 is then positioned on switch box 53, with the switch box extender 54 seated atop. The single outlet/receptacle 50 and switch box extender 54 are both secured by screws to switch box 53.

The switch box extender may be, for example, a ReceptXtender® electrical box extender which is known to meet all electrical codes, is U.L. approved and made from non-flammable, self-extinguishing materials. These box extenders are designed to shim out the single outlet/receptacle 50 flush with a wall covering.

When the switch box extender 54 is used in this plate-over configuration it submerges the single outlet/receptacle 50 slightly below the top surface of the window sill 25 and introduces a clearance between the receptacle 50 and cover plate 32. The candle assembly 30 is formed with a lower flange (as will be described). The diameter d1 of the aperture in the cover plate 32 is slightly smaller than the lower flange of candle assembly 30, and the cover plate 32 sits over the flange, thereby securing the candle 30 in its upright position (hence the name plate-over).

Figure 4:
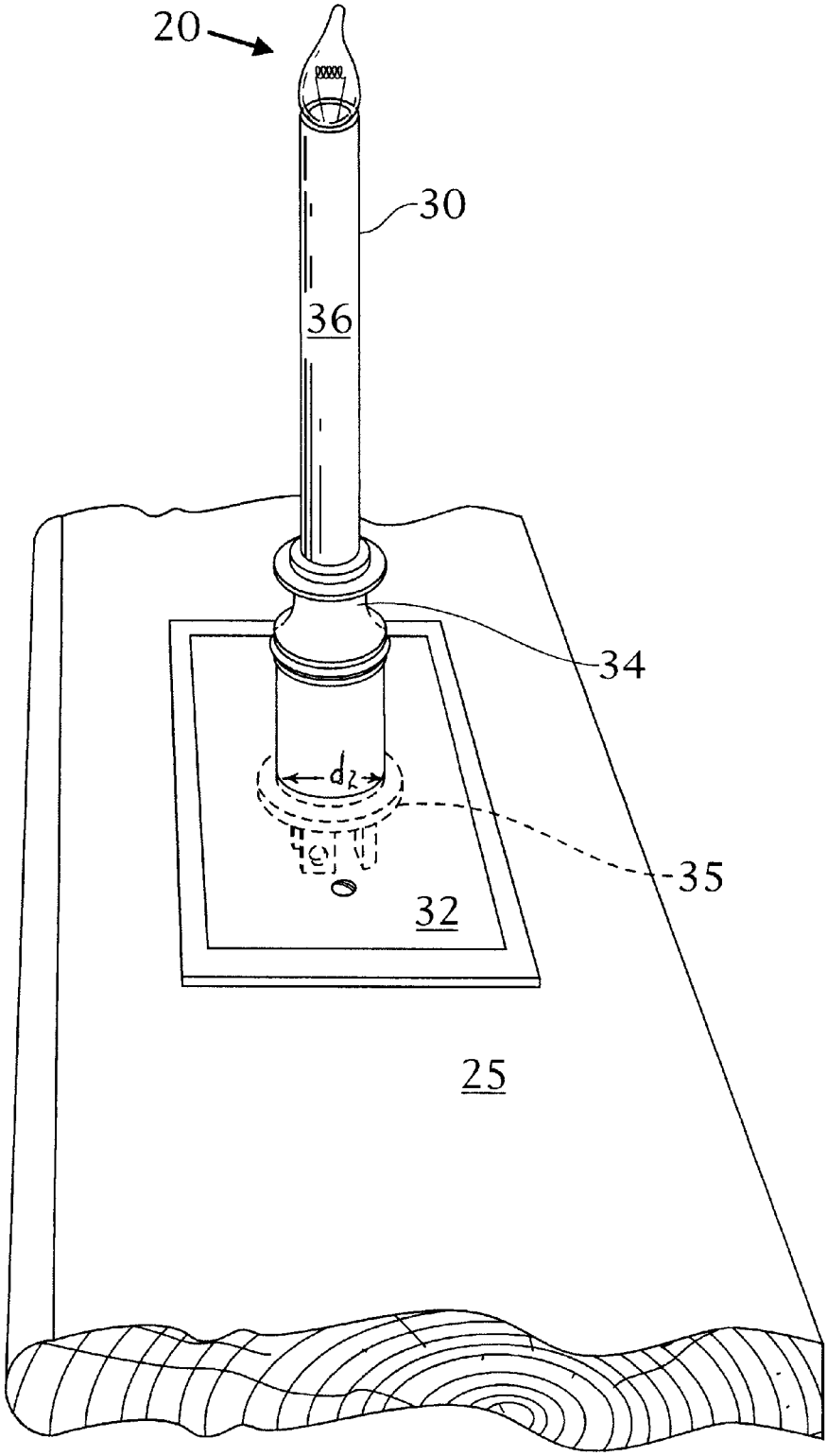
FIG. 4 is a close-up view of the exemplary window sill 25 and external base 34 of the direct plug electric candle lighting system 20, as in FIG. 3, showing how the cover plate 32 slides over the external base 34 to facilitate its installation (providing maximum safety).

FIG. 4 is a close-up perspective view of the exemplary window sill 25 with electric candle assembly 30 installed and cover plate 32 applied in the plate-over configuration. The external base 34 of candle assembly 30 is equipped with an enlarged mounting flange 35 encircling the bottom (shown in dotted lines). Given that the switch box extender 54 is mounted above both single outlet/receptacle 50 and switch box 53 as shown in FIG. 3, the single outlet/receptacle 50 sits slightly recessed below the top surface of the window sill 25. In this case, mounting flange 35 will remain recessed within the aperture beneath the surface of the window sill 25. The cover plate 32 is provided with an enlarged aperture sized to fit over the external base 34, but not the flange 35. Cover plate 32 thereby slides over the external base 34 to facilitate its screw-installation to receptacle 50, but it captures the mounting flange 35 beneath, thereby securing the external base 34 of candle assembly 30 in position. This plate-over configuration provides important safety benefits, especially in areas used by children, as it prevents removal of the candle assembly 30 and, thereafter, access to an exposed single outlet/receptacle 50.

In the plate-over configuration of FIGS. 3–4, the seating and grounding of the single outlet/receptacle 50 may be achieved by mounting it in any commercially available switch box 53 which is recessed approximately ¼" below the surface of the window sill 25.

When the foregoing plate-over configuration is unnecessary and quick removal of the candle assembly 30 is preferred, a plate-under configuration may be used as shown in FIGS. 1 and 2. In this case, the single outlet/receptacle 50 is mounted flush with the top surface of the window sill 25, the switch box extender 54 is eliminated, and the single outlet/receptacle 50 is positioned and secured by screws directly onto the switch box 53 in a conventional manner. This effectively elevates the single outlet/receptacle 50 such that the cover plate 32 sits flush overtop. The cover plate 32 is secured onto the switch box 53, and the diameter $d_2$ of the aperture in the cover plate 32 conforms to and abuts the outlet/receptacle 50. This way, when the candle assembly 30 is inserted into the receptacle 50, the enlarged mounting flange 35 at the bottom of external base 34 remains above the cover plate 32. Thus, the candle assembly 30 can be conveniently inserted into or removed from the receptacle 50 at will.

Should it ever be decided to convert from a plate-over configuration to a plate-under, this can be achieved by reversing the positions of the box extender 54 and receptacle 50, which causes receptacle 50 to be moved flush with the surface of the window sill 25. Installation of a cover plate 32 with diameter d of the aperture conforming to the outlet/receptacle 50 will complete the conversion.

Figure 5:
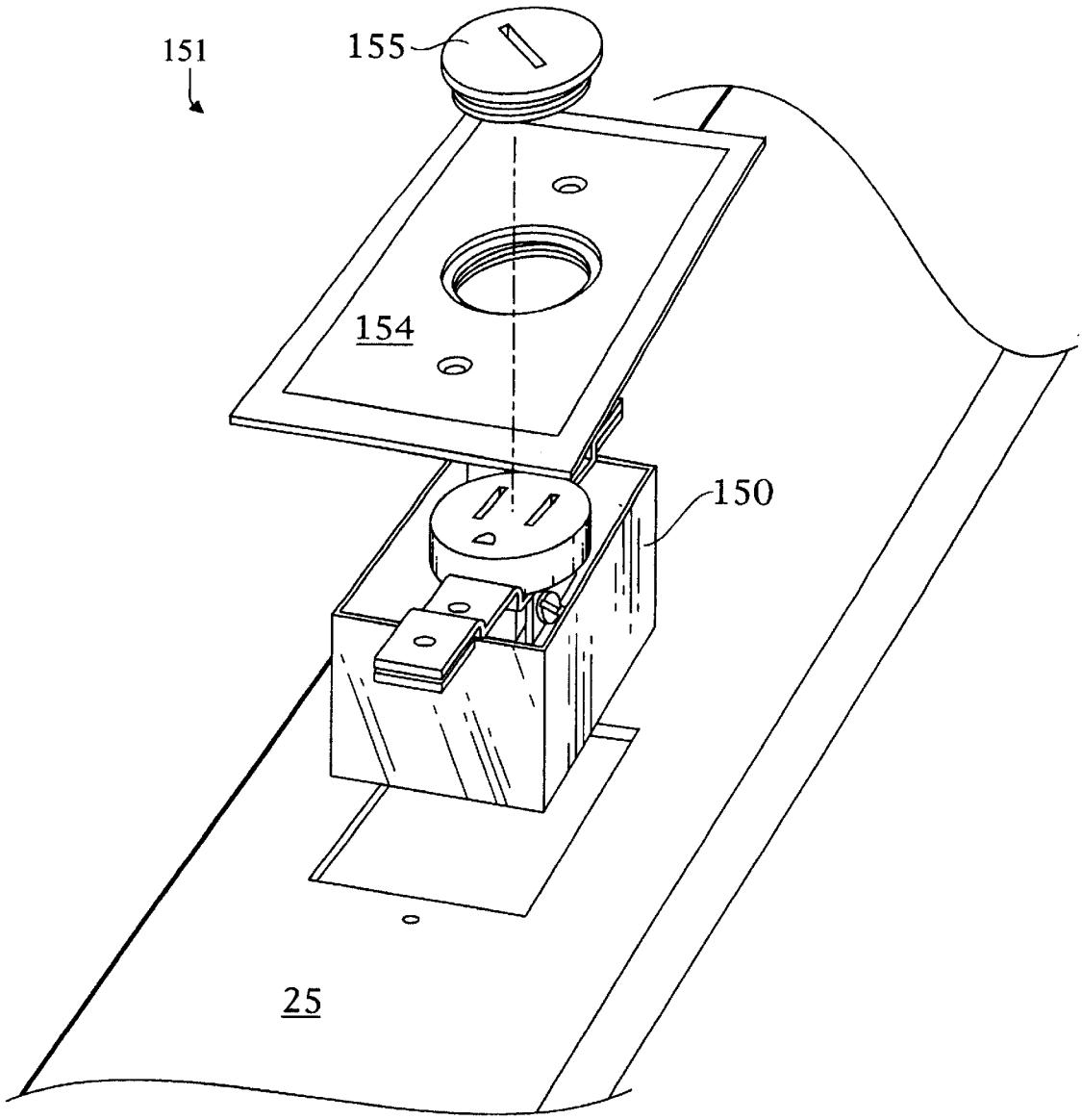
FIG. 5 is an exploded perspective drawing of a preferred floor/display outlet 151.

FIG. 5 is an exploded perspective drawing of an alternate floor display outlet installation 151 in window sill 25 which employs a display receptacle 150 (electric candle assembly 30 removed), brass cap 155 and brass cover plate 154. Floor display outlet installation 151 (a.k.a. "floor receptacle") is a commercially available assembly that can be purchased from various sources including Leviton® catalog no. 5250. Display outlet installations 151 are traditionally used for floor-mounting. However, when used for the purpose of the direct plug candle system in window sill 25, display outlet installation 151 offers maximum security, safety and aesthetics when candle assembly 30 is not in use. The display outlet installation 151 generally comprises a pre-assembled switch box/receptacle assembly 150 in which a single receptacle is enclosed in and secured to an open-front switch box. A brass cover plate 154 attaches over the display receptacle 150, and a brass cap 155 screws into brass cover plate 154 to close off the display receptacle 150. It is noteworthy that the use of an existing display outlet installation 151 in the present context will result in the electrical outlet being recessed approximately ½–¾" below the surface of the window sill 25. Thus, in order to adapt, the candle assembly 30 must be modified with an extended plug that reaches down into the cavity in order to plug snugly into the floor outlet receptacle 150. On the other hand, when candle assembly 30 is removed, the screw-on brass cap 155 is reapplied to seal off the underlying receptacle(s). This preserves the aesthetics of the cover plate 154 and prevents exposure to the receptacle.

Figure 6:
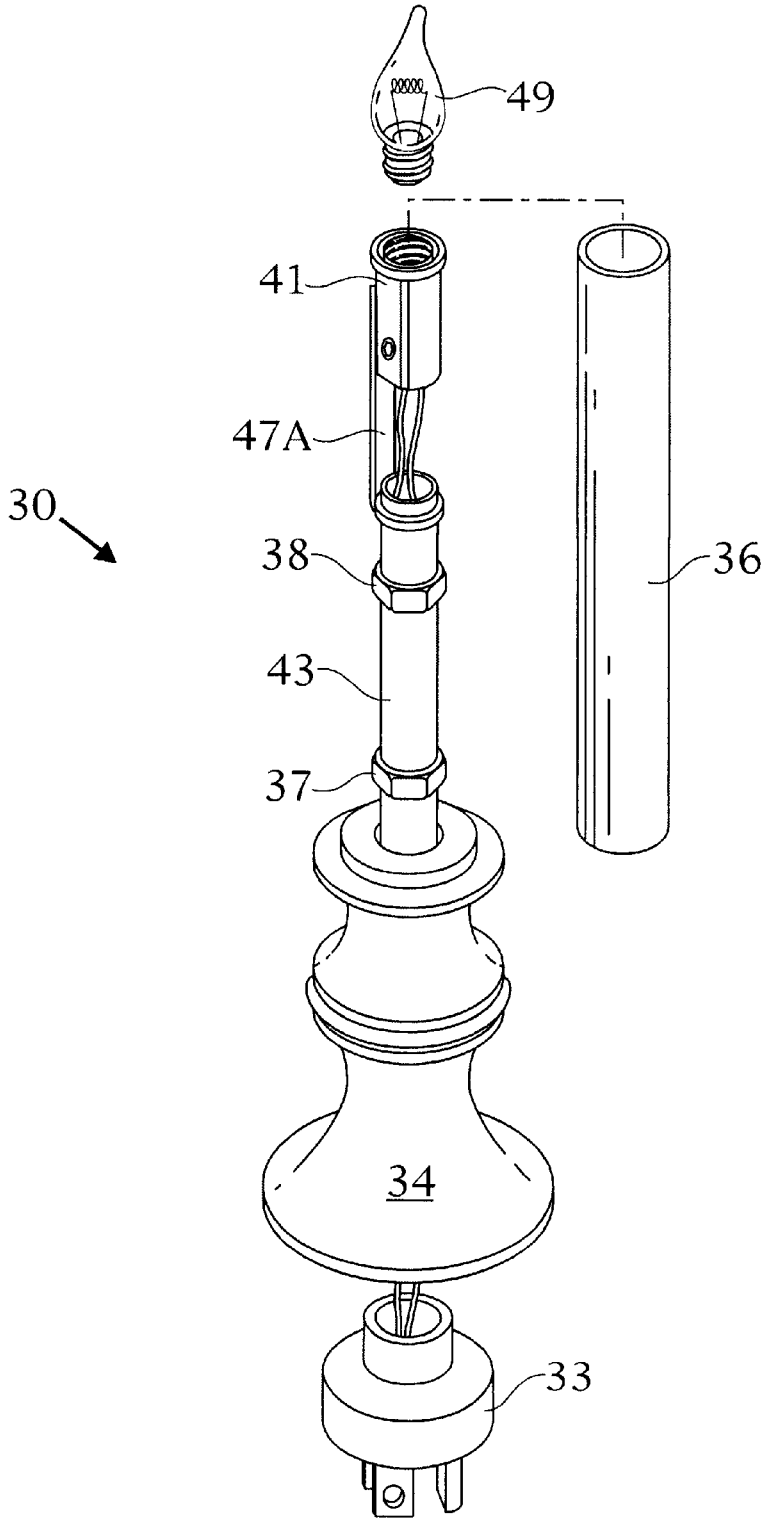
FIG. 6 is a side perspective view of the electric candle assembly 30 with the candle body removed to expose threaded body 43.

FIG. 6 is a side perspective view showing the internal detail of the electric candle assembly 30 according to the present invention.

The electric candle assembly 30 preferably includes a base plug 33 secured to a threaded hollow cylindrical body 43, the external base 34 for covering the base plug 33, a candle body 36 for covering threaded body 43 and providing the candle-like appearance, a lower locking nut 37 and an identical upper locking nut 38 threaded onto the threaded body 43, and a pigtail candelabra base socket 41 (with integral securing stand and electrical wiring). In addition, a low wattage (for example 7.5 watt, 120 VAC) light bulb 49 is included to complete the circuit.

The external base 34 is a hollow cylinder with an hourglass-shape and a furled top indent for seating candle body 36. The external base 34 is manufactured to specification (as is cover plate 32) to provide the proper dimensions and finish, and it may be fabricated of brass, nickel, or copper with surface finishes ranging from brightly polished to satin to brushed.

The candle body 36 may be a section of plastic tubing that is cut to an appropriate length. The commercially available pigtail candelabra base socket 41 contains a threaded receptacle for the light bulb 49, and an integral mounting stand 47A and wiring. The light bulb 49 is preferably a low wattage unit possessing a tapered shape similar to that of a candle flame. The internal electrical contacts of these pigtail housings are well-insulated, and these device are generally UL approved. However, there may be other sockets that are suited for use with the present invention, some with exposed electrical contacts, in which case a short section of cardboard insulating tube may be used to cover the bulb socket housing 41 to provide proper insulation.

Figure 7:
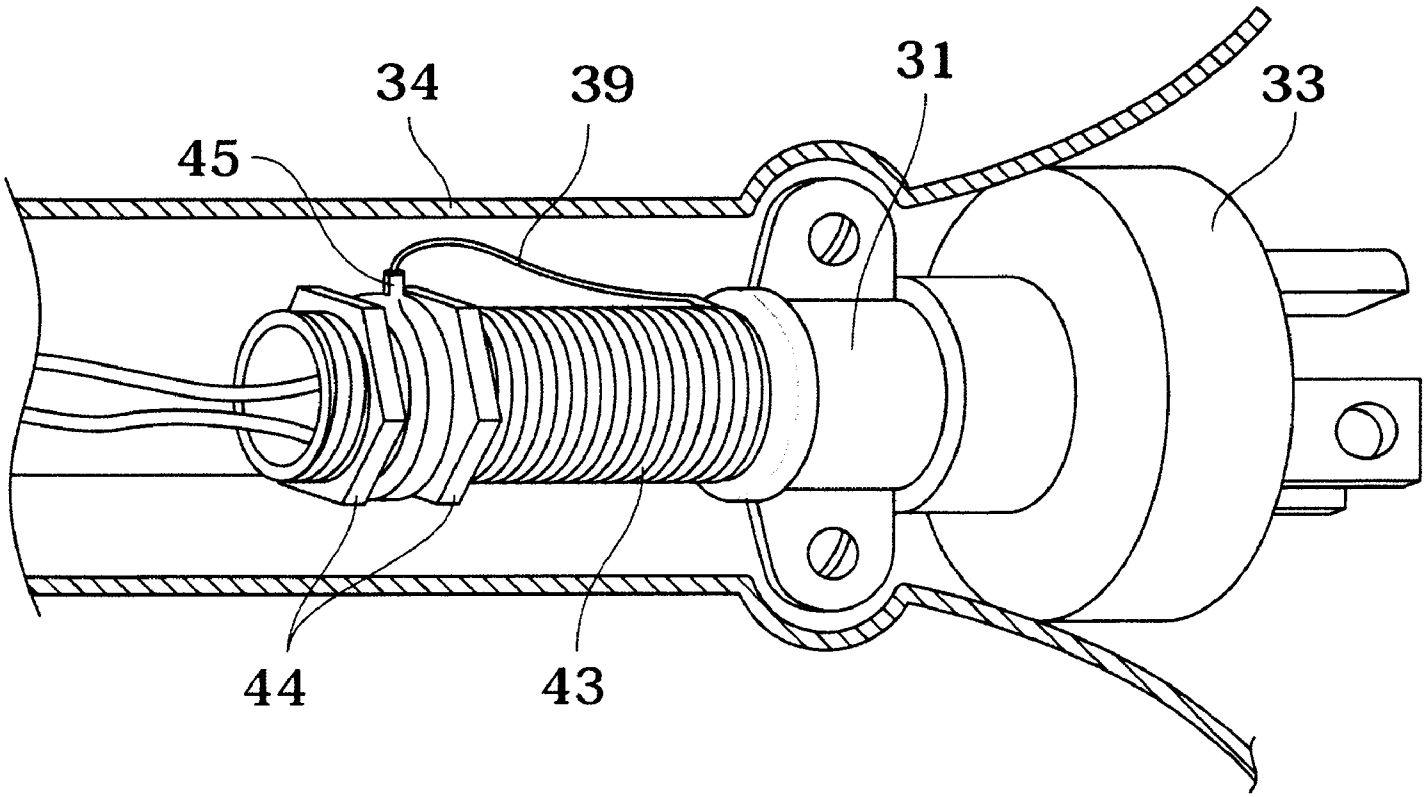
FIG. 7 is a close-up perspective view of the electric candle assembly 30, with base plug 33 exposed.

FIG. 7 is a close-up perspective view of the lower end of the electric candle assembly 30 of FIG. 6 with base plug 33 exposed. The base plug 33 is a commercially available, grounded plug rated for a maximum current of 15 amps and a maximum voltage of 125 volts. Base plug 33 includes a tightenable collar 31 and an internal connection (e.g. a ground screw) for attachment of a ground wire 39, and ground wire 39 is connected thereto. The other end of the ground wire 39 is terminated by an approved ring terminal 45 that is sandwiched between two locking nuts 44 to provide a ground path to the threaded body 43. This construction relies on threaded body 43 to add great rigidity and stability to the candle assembly 30. Threaded body 43 may be a piece of metal tubing that possesses a continuously-threaded outer surface and is cut to an appropriate length. Since the threaded body 43 makes contact with the external base 34, the entire candle assembly 30 is effectively grounded and offers the ultimate in "safety."

Assembly of the electric candle assembly 30 is as follows. Live wiring (not shown in the Figures) is fixedly attached to the appropriate contacts contained within the pigtail socket housing 41 and is passed through the hollow core of the threaded body 43. The upper locking nut 38 and the support neck 47A of the bulb socket housing 41 are then screwed onto the top end of the threaded body 43. Once the neck 47A of socket housing 41 is fully inserted and engaged with the threaded body 43, the upper locking nut 38 is tightened there against to lock the pigtail socket housing 41 in position just on the upper end of the threaded body 43. This allows the short lengths of live wiring hanging out of the top end of the threaded body 43 to be fixedly attached to the leads of the base plug 33, thereby providing the electrical connection required by the light bulb. With the base plug electrically attached, it is then physically attached to the threaded body 43 as shown in FIG. 7. The lower end of the threaded body 43 is fixedly attached to the neck of the base plug 33 by the collar 31, and short lengths of the live wiring are allowed to hang out of the body's bottom end. A ground wire 39 is fixedly attached to the appropriate contact contained within the base plug 33 and passes along the outside of the threaded body 43 before being attached to the body 43 by the ring terminal 45 and the two locking nuts 44.

The candle body 36 slides over the external surface of the pigtail socket hosing 41 and covers the exposed portion of the threaded body 43 before its lower end comes to rest slightly inside the top end of the external base 34 for a pressure fit (epoxy may be used to secure the candle body 36 to the external base 34). This leaves the top end of the candle body 36 slightly above (⅛ to 1/16" above) the top end of the pigtail socket housing 41. The assembly process is completed by screwing the light bulb into the socket housing 41.

Referring back to FIG. 2, the act of plugging the candle assembly 30 into the single outlet/receptacle 50 creates a situation where the electric candle cannot/will not fall over. The combination of three-point support for the standing candle assembly 30 (provided by the grounded three-prong plug 33) coupled with the stability of the threaded hollow cylindrical body 43 provides great integrity. If a candle assembly 30 is removed from the single outlet/receptacle 50, the outlet/receptacle 50 can be used as a normal outlet/receptacle for any device requiring 120 VAC electric service.

The wiring used to connect the above-described outlet/receptacle 50 to a 120 VAC supply may be any suitable code-approved wiring running inside the wall. However, for certain types of installations (such as remodeling, retrofitting existing homes, or some new construction), it is more cost effective to draw power directly from an existing outlet or switch. In this case, wire is run externally from the outlet or switch, and for aesthetic purposes it is best if the wire is not noticeable. Flat wiring is best in this situation because it is a very flat and unnoticeable wire that is accompanied by an array of connector choices, all of which minimize the intrusiveness of the external wiring. Thus, the flat wire may be run externally across the wall and coupled directly to the sill 25 (or internally therein) to power the candle assembly 30.

Alternative embodiments of the direct plug electric candle lighting system 20 include aesthetic variations in the external base 34, the candle body 36, and the threaded body 43. The external base 34 may be supplied in a variety of different metals, shapes and/or surface finishes (e.g. satin brushed nickel, antique copper). All external base variations are interchangeable to provide the user with flexibility in his/her decorating style. Variations in the candle body 36 include length (i.e. overall height of the candle assembly 30—also impacting the threaded body) and color (e.g. white, navy, cranberry, etc.). As with the external bases, the candle body variations are interchangeable. Multiple unit adapters, providing for the use of more than one candle assembly 30 with a single external base 34 and/or single outlet/receptacle 50, are also available.

Figure 8:
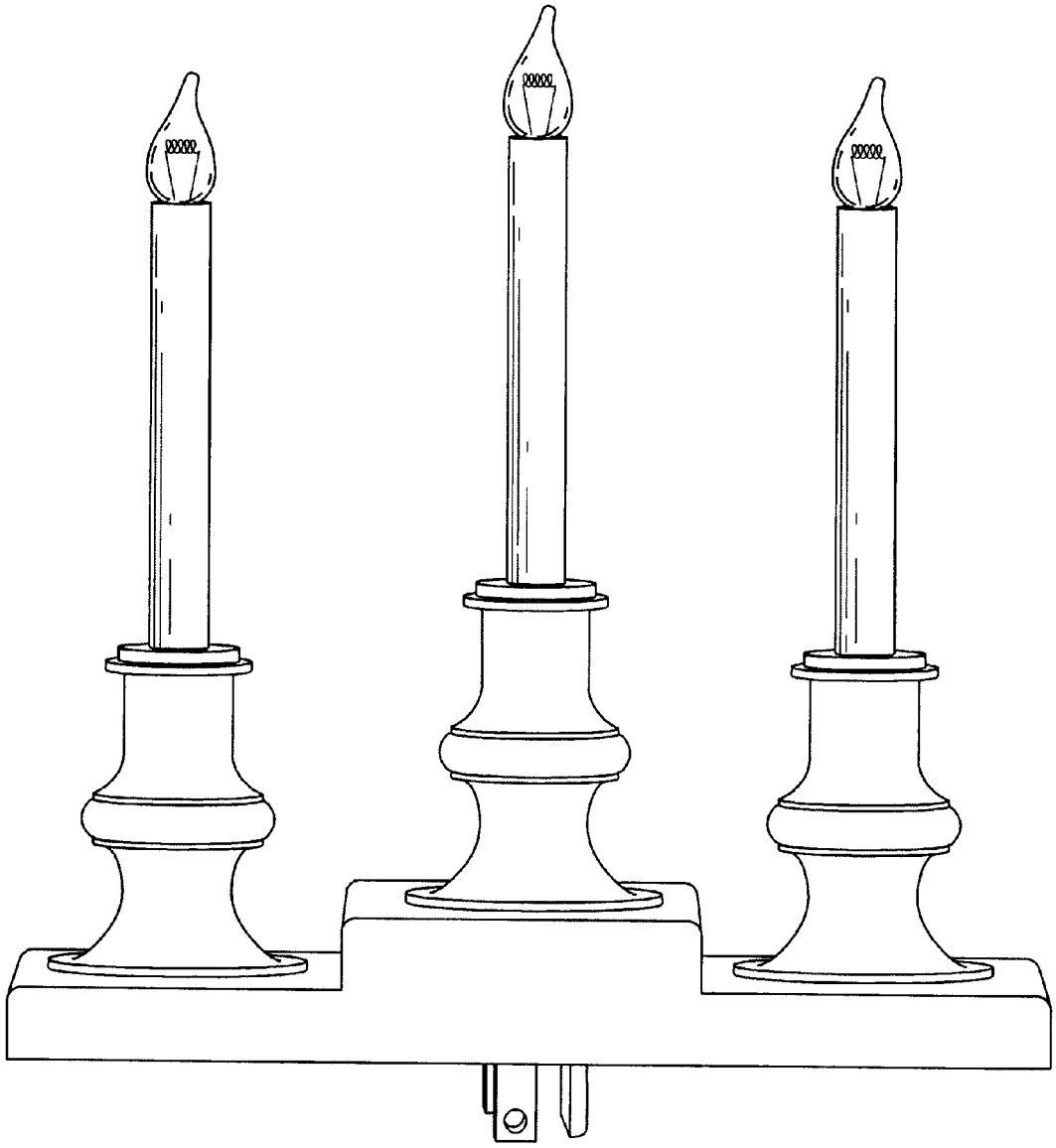
FIG. 8 is a perspective view of a candelabra 90 assembly which combines three electric candle assemblies 30 in a unitary plug-in configuration.

For example, FIG. 8 is a perspective view of a candelabra 90 assembly which combines three electric candle assemblies 30 wired in parallel in a unitary plug-in configuration for use with a single outlet/receptacle.

There may be certain limitations which prevent the use of full size electric boxes in window sills. It should be understood, therefore, that the dimensions of the electric box of the present invention may be reduced without departing form the scope or spirit of the invention. Specifically, an alternate construction using snap-in convenience outlets is possible. An example of a suitable convenience outlet is the Leviton 1374-001 product. To accommodate these snap-in convenience outlets, a smaller form-fitting electric box is recessed into the window sill. This form-fitting box seats the snap-in convenience outlet flush with the sill. As an additional convenience, the smaller electric box can be connected using non-metallic sheath wire (NMS) attached in pigtail fashion. The other end of the NMS is connected to the nearest outlet or switch. It is noteworthy that no receptacle cover plate is needed with this installation.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

I claim:

1. A direct plug electric candle lighting system, comprising:

a window sill;

a standard UL-approved three-hole (grounded) electric receptacle mounted in said window sill, said electric receptacle being connected to a standard 120 VAC power source;

a cover plate having an aperture, said cover plate being secured over said electric receptacle with the receptacle holes exposed through the cover plate aperture; and an electric candle assembly, said candle assembly further comprising a standard UL-approved (grounded) three-prong plug adapted for insertion into said receptacle, a hollow cylindrical body anchored at one end to said plug, a socket anchored to another end of said cylindrical body and electrically connected to said plug by conductor running through said cylindrical body, a bulb screwed into said socket, and a hollow cylindrical external base encircling all of said plug, body, and socket.

2. A direct plug electric candle lighting system, comprising:

a window sill;

a standard UL-approved three-hole (grounded) electric receptacle mounted in said window sill, said electric receptacle being connected to a standard 120 VAC power source;

an electric candle assembly, said candle assembly further comprising a standard UL-approved (grounded) three-prong plug adapted for insertion into said receptacle, a hollow cylindrical body anchored at one end to said plug, a socket anchored to another end of said cylindrical body and electrically connected to said plug by a conductor running through said cylindrical body, a bulb screwed into said socket, and a hollow cylindrical external base formed with a lower annular lip having a first diameter; and a cover plate having an aperture with a second diameter that is smaller than the first diameter of said lip, said cover plate being adapted to drop down over the cylindrical external base of said candle assembly and attach to said receptacle such that the lip of said external base is trapped thereunder to prevent removal.

3. The direct plug electric candle lighting system according to claim 2, wherein the plug of the electric candle assembly further comprises a three-prong plug for securing said candle assembly in said receptacle in a substantially vertical position.

4. The direct plug electric candle lighting system according to claim 2, wherein said electric receptacle and cover plate are components of a unitary floor mount receptacle.

5. The direct plug electric candle lighting system according to claim 4, wherein said unitary floor mount receptacle further comprises a screw-in cap for covering said receptacle when said candle assembly has been removed;

wherein attaching said screw-in cap over said receptacle increases safety by preventing access to said receptacle when said receptacle is not in use.

6. A direct plug electric candle lighting system, comprising:

a window sill;

a standard-UL-approved three-hole (grounded) electric receptacle mounted in said window sill, said electric receptacle being connected to a standard 120 VAC power source;

an electric candle assembly, said candle assembly further comprising a standard UL-approved (grounded) three-prong plug adapted for insertion into said receptacle, a multiple unit adapter encompassing said plug, multiple hollow cylindrical external bases formed with annular lower lips for anchoring in said multiple unit adapter, multiple hollow cylindrical bodies anchored at one end in said multiple unit adapter, multiple sockets anchored to another end of said cylindrical bodies and electrically connected to said plug by wire running through said cylindrical bodies, and multiple bulbs screwed into said sockets; and a cover plate secured on said window sill, said cover plate having an aperture with a diameter conforming to the electric receptacle mounted in said window sill.

7. The direct plug electric candle lighting system according to claim 6, wherein said electric candle assembly further comprises:

a base plug for securing said candle assembly in said receptacle in a substantially vertical position;

a decorative, interchangeable multiple unit adapter;

multiple decorative, interchangeable external bases;

multiple decorative, interchangeable candle bodies;

multiple bulb socket housings; and multiple decorative, interchangeable, low wattage light bulbs.

8. The direct plug electric candle lighting system according to claim 6, wherein a solid cover plate is fixedly attached over said receptacle after said cover plate, said multiple unit adapter, said external bases, and said candle assemblies have been detached from said receptacle;

wherein attaching said solid cover plate over said receptacle increases safety by preventing access to said receptacle when said receptacle is not in use.

9. An electric candle assembly adapted for insertion into a conventional UL approved grounded outlet including a decorative cover plate and a receptacle exposed through an aperture in the cover plate, said receptacle being connected to a standard 120 VAC power source, comprising a standard UL-approved (grounded) three-prong plug for insertion into said receptacle, a hollow cylindrical body anchored at one end to said plug, a socket anchored to another end of said cylindrical body and electrically connected to said plug by a conductor running through said cylindrical body, a bulb screwed into said socket, and a hollow cylindrical external base formed with a lower annular lip having a diameter slightly larger than the aperture in said cover plate.

* * * * *